US008915308B2

(12) United States Patent
Joergensen et al.

(10) Patent No.: US 8,915,308 B2
(45) Date of Patent: Dec. 23, 2014

(54) APPARATUS AND A METHOD FOR HEIGHT CONTROL FOR A DOZER BLADE

(75) Inventors: Claus Joergensen, Odense (DK); Lars Kjaergaard, Odense (DK)

(73) Assignee: Mikrofyn A/S, Odense (DK)

( * ) Notice: Subject to any disclaimer, the term of this patent is extended or adjusted under 35 U.S.C. 154(b) by 22 days.

(21) Appl. No.: 13/582,381

(22) PCT Filed: Mar. 5, 2011

(86) PCT No.: PCT/DK2011/000014

§ 371 (c)(1),
(2), (4) Date: Aug. 31, 2012

(87) PCT Pub. No.: WO2011/107096

PCT Pub. Date: Sep. 9, 2011

(65) Prior Publication Data

US 2012/0318539 A1 Dec. 20, 2012

(30) Foreign Application Priority Data

Mar. 5, 2010 (DK) ..... 2010 00174

(51) Int. Cl.
*A01B 63/111* (2006.01)
*E02F 3/84* (2006.01)

(52) U.S. Cl.
CPC ..... *E02F 3/845* (2013.01); *E02F 3/847* (2013.01)
USPC ..... 172/4; 37/197; 701/50

(58) Field of Classification Search
USPC ..... 172/2, 4, 4.5; 701/50; 37/197, 414
See application file for complete search history.

(56) References Cited

U.S. PATENT DOCUMENTS

| | | | | | |
|---|---|---|---|---|---|
| 3,058,242 | A | * | 10/1962 | Ocnaschek | 172/4.5 |
| 3,831,683 | A | * | 8/1974 | Ikeda et al. | 172/4.5 |
| 4,157,118 | A | * | 6/1979 | Suganami et al. | 172/4.5 |
| 4,162,708 | A | * | 7/1979 | Johnson | 172/4.5 |
| 4,923,015 | A | * | 5/1990 | Barsby et al. | 172/4.5 |
| 5,174,385 | A | * | 12/1992 | Shinbo et al. | 172/4.5 |
| 5,551,518 | A | * | 9/1996 | Stratton | 172/4.5 |
| 5,560,431 | A | * | 10/1996 | Stratton | 172/2 |
| 5,860,480 | A | * | 1/1999 | Jayaraman et al. | 172/2 |
| 5,964,298 | A | * | 10/1999 | Greenspun | 172/4.5 |
| 5,987,371 | A | * | 11/1999 | Bailey et al. | 701/50 |
| 6,108,076 | A | * | 8/2000 | Hanseder | 356/141.1 |

(Continued)

FOREIGN PATENT DOCUMENTS

| | | |
|---|---|---|
| EP | 1630636 A2 | 3/2006 |
| WO | 2011022477 A2 | 2/2011 |

*Primary Examiner* — Matthew D Troutman
(74) *Attorney, Agent, or Firm* — Maschoff Brennan

(57) ABSTRACT

Automatic height control of a dozer blade, the input from the slow absolute height sensor is combined with an input from a gyroscope that measures the instant rotation and recalculates it into a vertical height change using the length of the supporting arms. The combination obtains the accuracy of the absolute height information and an increased speed of measurement resulting in a compensated height estimate that is input to a hydraulic control system of the feedback type. This enables much more aggressive control even though the hydraulic system has an unknown linearity and delay associated with it. The gyroscopic sensor forms an IMU with one degree of freedom to compensate for drawbacks of the absolute height sensor with regard to delay, noise and update rate to obtain a frequent, time-correct height position with a reduced level of noise by means of a calculation based on both types of sensor output.

13 Claims, 3 Drawing Sheets

(56) References Cited

U.S. PATENT DOCUMENTS

| | | | | |
|---|---|---|---|---|
| 7,317,977 | B2 * | 1/2008 | Matrosov | 701/50 |
| 2006/0070746 | A1 | 4/2006 | Lumpkins et al. | |
| 2008/0073089 | A1 * | 3/2008 | Green | 172/2 |
| 2008/0087447 | A1 | 4/2008 | Piekutowski | |
| 2008/0109141 | A1 | 5/2008 | Nichols et al. | |
| 2008/0199294 | A1 | 8/2008 | Sahlin et al. | |
| 2009/0069987 | A1 | 3/2009 | Omelchenko et al. | |
| 2012/0000681 | A1 * | 1/2012 | Douglas | 172/1 |
| 2012/0059554 | A1 * | 3/2012 | Omelchenko et al. | 701/50 |
| 2012/0130602 | A1 * | 5/2012 | Omelchenko et al. | 701/50 |

* cited by examiner

APPARATUS AND A METHOD FOR HEIGHT CONTROL FOR A DOZER BLADE

FIELD OF THE INVENTION

The invention relates to an apparatus for controlling in a closed loop the height of a blade of a dozer or similar front mounted blade on earth moving equipment, said blade forming an aggregate with a pair of supporting arms connected to the dozer or similar earth moving equipment at pivot points and rotated in planes perpendicular to the connecting line between said pivot points by means of hydraulic cylinders supplied via valves, said blade carrying at least one absolute height sensor, said aggregate carrying one inertial sensor, the outputs of said sensors being combined in a calculating unit, the output of said calculating unit and a set height being compared in a comparator, the output of said comparator providing the input for a regulator for controlling said valves.

The invention also relates to a method of forming a surface on the ground using said apparatus.

This invention is intended to improve precision in dozer work, meaning a smoother surface at a higher operating speed, and it is not an aim to improve absolute accuracy of the resulting surface.

BACKGROUND

In the present description the designation dozer or bulldozer is used for both the specific earth moving equipment known as a 'dozer' in the trade and for similar earth moving equipment having a height adjustable blade at the front.

In the present description the designation IMU is used for an inertial sensor with one gyroscope only.

In the present description the designation pivot-to-surface distance is used for the fixed distance between the surface that the dozer or similar earth moving equipment is moving on and the pivots that are attachments for support arms for the cutting blade and around which the aggregate constituted of supporting arms and cutting blade performs a rotary movement under the influence of hydraulic cylinders. In practice a dozer will under most circumstances move on a surface that has been subjected to the action of the blade and which hence is close to the design surface in its properties.

A dozer with a blade is well-known for use as earthmoving equipment in shaping surfaces with respect to elevation and inclination, such as in the profiling of roads. Another way of expressing it is that a dozer performs a function of preparing a surface defined by the line of the cutting edge of the blade when it is carried forward by the dozer. Manual operation of such equipment requires both great skill and previous accurate positioning of markers (reference points) to guide the height and tilt adjustments of the blade. Various systems comprising calculators are known that provide input to apparatus that will inform the operator of the adjustments needed from instant to instant. The blade is carried on supporting arms fitted on the chassis of the dozer at pivot points by means of bearings that permit a lifting and lowering of the blade, which hence performs a movement in an arc of a circle. This rotating motion can be converted into a vertical movement by knowledge of the machine geometry. The cutting edge must be controlled to a high precision, but overshoot, residual oscillation, and stepwise changes must usually be avoided in dozer work. The need for working at a high speed is mainly relevant when the work is in straight horizontal lines or straight planes. This type of work constitutes the majority of the cases. If an automatic control is used, height and angle information is used as the target value in a feedback loop controlling the hydraulics of the dozer.

The supporting arms for the dozer blade are moved by means of hydraulic cylinders that are supplied with hydraulic liquid under pressure via valves that are controlled manually, or as in the present apparatus, by means of electromagnetic valves that are activated under the control of the apparatus. The viscosity of the fluid and the supply provided by the valves are both temperature and working pressure dependent, and these are essentially non-linear relationships that can, however, be made to work inside a negative feedback loop. All the well-known problems with feedback loops are obviously also present here. This may be counteracted in well-known ways by the use of PID controllers, but the system may thereby become too slow for a speed that is within the capabilities for earth-moving of the dozer. However in order to utilise the speed optimally, special corrective means are required.

In order to obtain a target surface, absolute references are required. The reference information is required on a continuous basis and with a rate of updating that is commensurate with the speed of automatic operation. Virtual references are obtained by means of GNSS systems, in which a receiver processes signals from several transmitting satellites in order to calculate a three-dimensional position of the antenna. When this antenna is placed on a pole on the blade its vertical position at the time of measurement is provided with sufficient accuracy, however, if the blade is moving this is only a historical fact, due to latencies caused by amongst other things calculations and data transmission. The vertical noise level is dependent on a number of different factors, such as the number of simultaneous signals received, the position of each satellite, and the distance to the base station. It will also increase at high latitudes due to the orbits of the satellites. The update rate is typically high but this height reference type has a significant noise component and a non-negligible delay associated with it.

Another type of reference is obtained by means of a stationary active device placed at a location with accurate coordinates. This device, sometimes termed an Automatic Total Station (ATS), optically measures the distance and angle to a retro-reflecting device mounted on a pole and transmits this information to the calculator that applies trigonometric calculations in order to determine the position of the blade in space. The update rate is low and the latency large, however it is very accurate.

A further type of reference is obtained by means of a rotating or scanning laser beam from stationary equipment placed at a location with accurate coordinates. A receiver on a pole comprising several receiving elements provides information of the vertical position with respect to the laser plane. If it is desired to obtain a plane surface from the work of the dozer, the operator has merely to maintain the height or vary it according to a pre-determined rule. The update rate is typically quite high and the latency and noise level very low, however at long distances between the receiver and the rotating laser device the noise level increases—especially in windy conditions.

The first limiting factor with current systems with regards to performance is caused by drawbacks of the absolute height sensor in use. This height sensor on the blade provides input to the control system with an irregular, infrequent rate, which is delayed in time and further has a noise component. The degree of these different disadvantages depends on the absolute height sensor type in use.

A second limiting factor is that the hydraulic system, which is included in the control loop, has an unknown non-linearity and an unknown delay that may also change with time and temperature. Hence modelling the hydraulic system is in practice not possible, since the complex relationship between the control signal and the blade motion cannot be determined.

These two limiting factors have a significant influence on the performance of the control loop and these factors are the main bottlenecks in prior art with regard to operating speed and surface smoothness.

PRIOR ART

A block diagram describing the principle behind prior art solutions is shown in FIG. 1. The delay in the height measurement device will require less aggressive control parameters, which will result in reduced maximum possible dozer grading speed. The noise component will result in a non-smooth surface, and trying to reduce the noise in the height measuring device will always be a trade-off between noise-reduction and even further added filtering delay in the measuring device, resulting in even less aggressive control parameters and thus even further reduced maximum dozer grading speed.

If the absolute height measuring device had no delay and no noise associated with it, a basic control loop would suffice for high speed grading with a smooth end result. This invention therefore describes how to practically overcome the delay and heavily reduce the noise level of the absolute height measuring device by combining it with a second measuring device.

A frequently used method is to introduce an inertial measurement unit, IMU, which is able to improve the position estimate by combining the IMU with an absolute reference. Specifically for use with earth moving equipment the following patent texts are relevant prior art.

US2009/0069987 describes how an improved vertical position estimate may be obtained by means of a 6-axis inertial navigational system, INS, in combination with an absolute height reference. The inputs from all sensors are combined by means of complicated Kalman algorithms, although—with regard to the vertical position—the input from a vertical accelerometer is the most significant input. The vertical position is specifically estimated by a complementary filter approach with loose coupling to integrate the GNSS and IMU measurements. A limiting factor is that this publication does not use the information that the dozer travels on the finished surface and that the cutting edge moves in an arc of a circle about a point on the dozer body where the supporting arms for the cutting edge are attached.

In US2008/0109141 it is described how it is possible to extrapolate by means of absolute height determinations and thereby to obtain a height output for control of hydraulics with a higher update frequency. This method, however, does not compensate delays in the input of absolute sensor values, and any superimposed noise signal will have a full effect on the control output.

US2008/0087447 describes how a gyroscope on the body of the dozer senses rotation about an axis generally transverse to the dozer body and passing through the centre of gravity of the dozer body. This is used to compensate for the disturbance created when the machine rocks back and forth. An angle sensor that senses the relative position between the dozer arm and the dozer body is also used. Sensing the relative angle between the dozer arm and dozer body would require an angle measurement of both the dozer and the arm or alternatively by using machine geometry measuring the cylinder displacement. The outputs from these two sensing elements are combined with the output from a laser receiver mounted on the dozer blade used for controlling the dozer blade. According to the description, the dozer body rotation is the most important motion to measure and use as input to the hydraulic control.

When manufacturing an IMU with multiple degrees of freedom as used in the prior art it is important that the direction of sensitivity of each sensor element is either parallel or perpendicular to the others. Also, it is important that the gain factors on equal types of sensors are matched. To achieve this, an individual adjustment and calibration of each IMU is normally required during manufacture. This is in particular a disadvantage when using BTUs with many degrees of freedom.

SUMMARY

The above disadvantages in the prior art are avoided in an apparatus according to the invention, which is particular in that said one inertial sensor has one degree of freedom, the output of which is angular velocity in a plane perpendicular to the connecting line between said pivot points, which for use in said calculating unit is converted to angular increment of said supporting arms in said plane. According to the invention a system has been obtained that uses an IMU that does not need more than one degree of freedom.

An advantageous embodiment is particular in that the calculating unit further applies a conversion factor when converting from angular increment to a height displacement at the dozer blade. According to a further embodiment the conversion factor is the length of the supporting arm. This is an embodiment that is related to the type of calculation performed in the calculating unit in order to obtain a result suitable for the comparator. A further advantage is that no advanced calibration method is required when installing the IMU onto a machine. The only machine specific calibration value that it may be needed to measure, is the length of the supporting arm and it is not important that this length be measured with great accuracy.

A further advantageous embodiment is particular in that the inertial sensor is highly insensitive to linear accelerations and rotation out of a plane perpendicular to the connecting line between said pivot points. This is a requirement that ensures that disturbing signals that would generate output in sensors with several degrees of freedom do not influence the output of the inertial sensor. A further advantageous embodiment of the invention is particular in that the sensor is a gyroscope for sensing angular velocity of the supporting arms. The function of certain constructions of gyroscope is enhanced by the use of bias-compensation for the output.

According to a further advantageous embodiment of the invention the inertial sensor is mounted on the dozer blade. The particular advantage of this embodiment is that for machine control systems, a sensor on the blade of the dozer is already necessary in order to measure the inclination of the blade perpendicular to the driving direction.

Therefore it is straightforward to implement this new sensor into existing sensor housings and provide both regular inclination functionality as well as new improved height control due to the added inertial sensor. This means that housing, cables, processor/calculator platform, mounting tools, and similar hardware can be re-used.

A further advantageous embodiment makes use of the fact that the angular increment affects all parts of the aggregate of supporting arms and blade. For this reason the inertial sensor is mounted on one of the supporting arms. A backup may be obtained by using one inertial sensor on each arm.

It is of particular importance to mount the inertial sensor on a supporting arm in the case that the blade is a so-called 6-way blade, which permits adjustment of various angles of the blade with respect to the surface or the body of the dozer.

Further embodiments are distinguished by the choice of absolute height sensor, each with their advantages or disadvantages and with a specific need for data interpretation by the calculating unit.

A method using this apparatus for forming a surface on the ground by earth moving equipment such as a dozer, with a pair of supporting arms for the blade, said blade being controlled in a closed loop when lifted and lowered by means of hydraulic cylinders supplied via valves, comprises the steps of:

inputting a target surface profile to the control loop; automatically receiving measurements from at least one absolute height sensor mounted on the blade;

automatically receiving measurements from one inertial sensor with one degree of freedom mounted on the aggregate consisting of the dozer blade and its supporting arms; automatically feeding said measurements to a calculating unit, which gives an input to a regulator for controlling said valves, thereby controlling an elevation of the dozer blade based at least in part on the measurements received from the at least one height sensor and the measurements received from the one inertial sensor, while setting the earth moving equipment in motion.

According to the present invention, neither the angle nor rotation of the body or the relative angle between the body and the arm is important. The present invention instead states that the most important motion to measure is the angular velocity of the dozer arm, and even the actual angle of the dozer arm is not important. In the present invention the rotation of the dozer arm is instead measured by use of an IMU mounted on the dozer arm or dozer blade, which can then be converted to a corresponding height estimate change at the edge of the blade. This is the most important motion to sense, since this motion is directly affected by the control signal from the regulator.

According to the present invention approaches based on combination with non-absolute sensors may be very much improved by the use of a single-axis IMU in the form of a single gyroscope that gives input to a calculating unit. According to the present invention a sensor is used that is not responsive to vibrations and linear accelerations and hence does not need any compensation to detect the angle increment of the blade.

This invention explains how to improve the quality of the information from the absolute measuring device used for controlling a dozer blade by combining this device with a second local measuring device. The rotation sensed can be caused by two things, the arm rotating due to the pistons moving—caused by the control signal from the regulator—or the arm rotating due to the whole machine rotating. The sensor sensing the rotation cannot distinguish between these two cases, but given the nature of how a dozer is used as an earthmoving machine, the rotation sensed by the whole machine rotating is only an additional benefit to also sensing the rotation of the arm caused by the control signal. This is because a rotation of the whole machine will always be caused by the dozer driving into bumps or holes—which then provides a beneficial contribution to the sensed rotation—and it can never be caused by the back of the machine being accidentally raised or lowered with the blade position fixed, which would cause an erroneous contribution. Due to this analysis of how a dozer is used, placing a sensor that senses the rotation of the arm—caused by the control signal or the whole machine rotating—is better than only sensing the control signal from the regulator, and it is not important to distinguish what kind of motion caused the sensed rotation of the arm.

Additionally, since we are only interested in measuring changes in the angle of the dozer arm and not its absolute angle or relative angle compared to the whole machine, we can avoid using inclination sensors, such as accelerometers, and solely use a single gyroscope to form the local measuring system that senses the rotation of the dozer arm. The benefit in this is that cheap, commercial gyroscopes are available, which are very immune to translateral accelerations and shocks, which could otherwise cause problems.

Dependent on the type of gyroscope in use it may or may not need bias compensation. Bias compensation is a well-known discipline for those skilled in the art. Cheap MEMS (Micro Electro-Mechanical Systems) based gyroscopes are the preferred type but other types can be used.

BRIEF DESCRIPTION OF THE DRAWINGS

The invention will be described in greater detail with reference to the drawing, in which.

DETAILED DESCRIPTION

Figure 1:
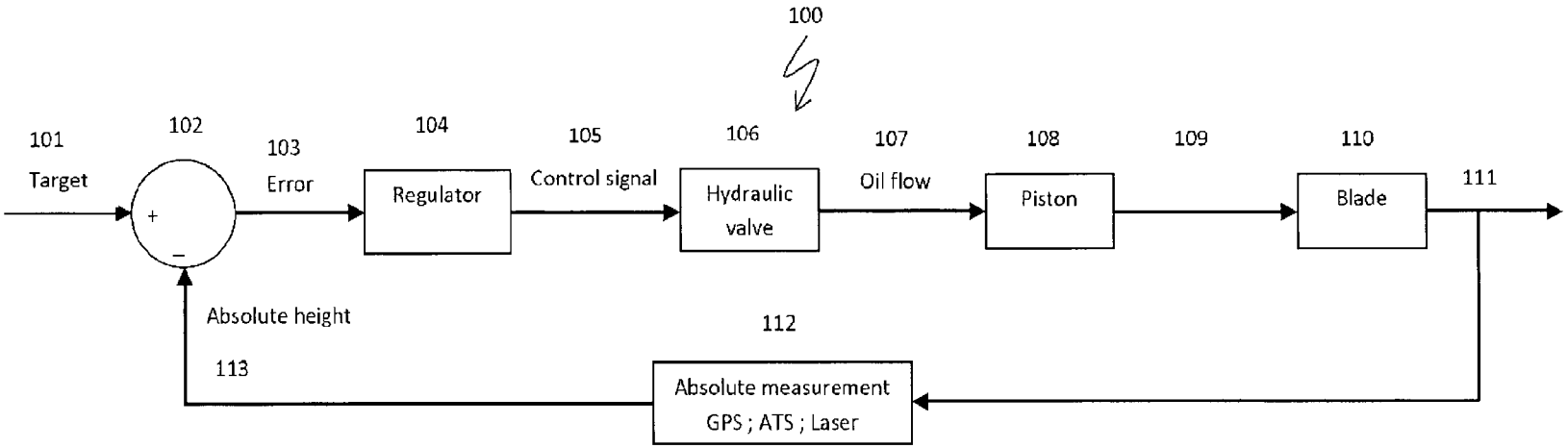
Fig. 1 (Prior Art)
FIG. 1 shows a prior art arrangement for controlling the blade of a dozer.

In FIG. 1 is shown a typical control system for a dozer blade. Known dozer systems consist of only one sensor used for controlling the height of the dozer blade. A typical prior art system diagram [100] of such a control loop is shown. This loop consists of a target height [101], which is the desired height to keep the dozer blade at, and a measured height [113], which is the output from the height sensor in use [112], which for example could be a GNSS sensor. The difference between the target height and the measured height is the error-input [103] to the regulator [104]. The regulator [104] then calculates a control signal [105] based solely on the height error [103] and a prior machine-specific hydraulic calibration, which has determined the regulator control loop parameters. The control signal [105] causes—via hydraulic valves [106]—the pistons [108] to move. Since the pistons [108] are attached to the dozer arm, the movement of the pistons [108] causes—through the movement of the supporting arm of the dozer—the blade [110] to move.

The drawbacks of this basic solution to controlling a dozer blade is that the absolute height measuring device [112] typically has delay and noise associated with it. This means the correlation between the true height [111] and the measured height [113] is not perfect. The optimal correlation between measured and true height is that the measured height at the current time equals the true height at the current time. But it is more correct to recognize that the measured height at the current time equals the true height some time ago with an added noise component.

If the absolute height measuring device [112] had no delay and no noise associated with it, the basic control loop shown in FIG. 1 would suffice for high speed grading with a smooth end result. This invention therefore describes how to practically overcome the delay and heavily reduce the noise level of the absolute height measuring device by combining it with a second measuring device.

This invention is based on the realization that a single gyroscopic sensor that is placed on the dozer supporting arm or dozer cutting blade and sensitive to rotation can be combined with an absolute measuring device as a GNSS sensor, in order to practically eliminate the delay and heavily reduce the noise level in the absolute measuring device.

Figure 2:
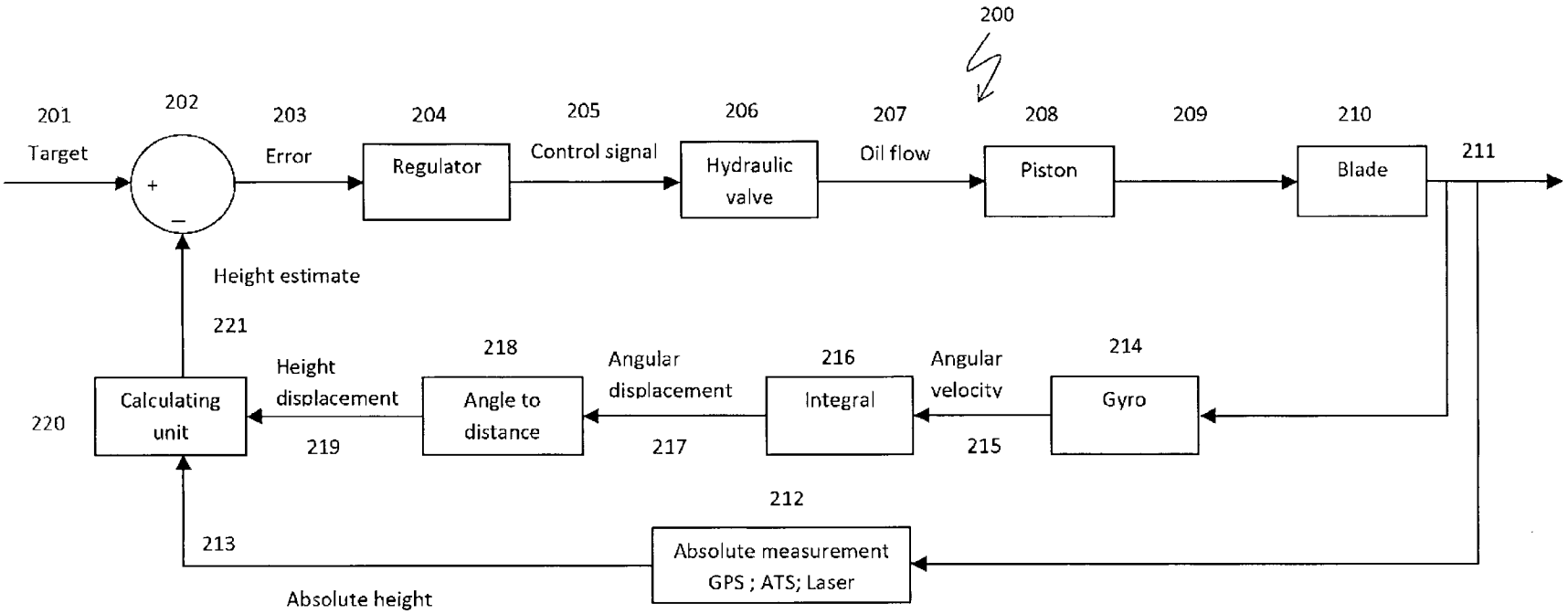
FIG. 2 shows a basic block diagram of an apparatus according to the invention.

The control loop used in the invention can be seen in FIG. 2. This control loop [200] has the same design as a regular control loop used with earth moving machines, except the measuring feedback system has been improved significantly by adding an additional gyroscopic sensor [214] into the height feedback system and combining its output [215] through minor calculations [216] and [218] with the absolute measuring device [212] in a calculating unit [220].

The output [215] of the gyroscopic sensor [214] is prepared for the calculator unit by first integrating its output over one time slice, which is the inverse of the frequency of the gyroscopic output data. The output [215] of the gyroscopic sensor [214] has now been converted by integration [216] from a measure of angular velocity [215] to a measure of angular displacement [217] occurring since the last data output from the gyroscopic sensor [214]. This angular displacement [217] is converted in [218] through basic geometry and the knowledge of the length of the dozer arm into a position displacement since last gyroscopic sensor output [215]. For practical purposes and recognizing that the dozer drives over the surface it has just created, it can be approximated into a linear conversion factor, which mathematically can be expressed as:

$$\Delta h \approx arm * \omega T$$

T: time interval between gyroscopic outputs
Δh: height displacement in the last T milliseconds
arm: length [309] of arm from pivot point to cutting edge
ω: angular velocity measured by gyroscopic sensor This position displacement result sensed through the gyroscopic sensor [214] enters the calculating unit [220] and is combined with the output [213] from the absolute measuring device [212] to a height estimate [221] with practically no delay and heavily noise-reduced as opposed to solely using the absolute measuring device. This height estimate combined from both the gyroscopic sensor and the absolute measuring device is then used in the control loop as usual by comparing it in [202] to the target height [201] and letting the resulting error [203] enter the regulator [204] for calculating a control signal [205] for controlling the system. Due to the addition of the gyroscopic sensor into the height feedback loop, all motion caused by the control signal [205] will immediately be sensed in the height feedback system, thus enabling very aggressive control.

Figure 3:
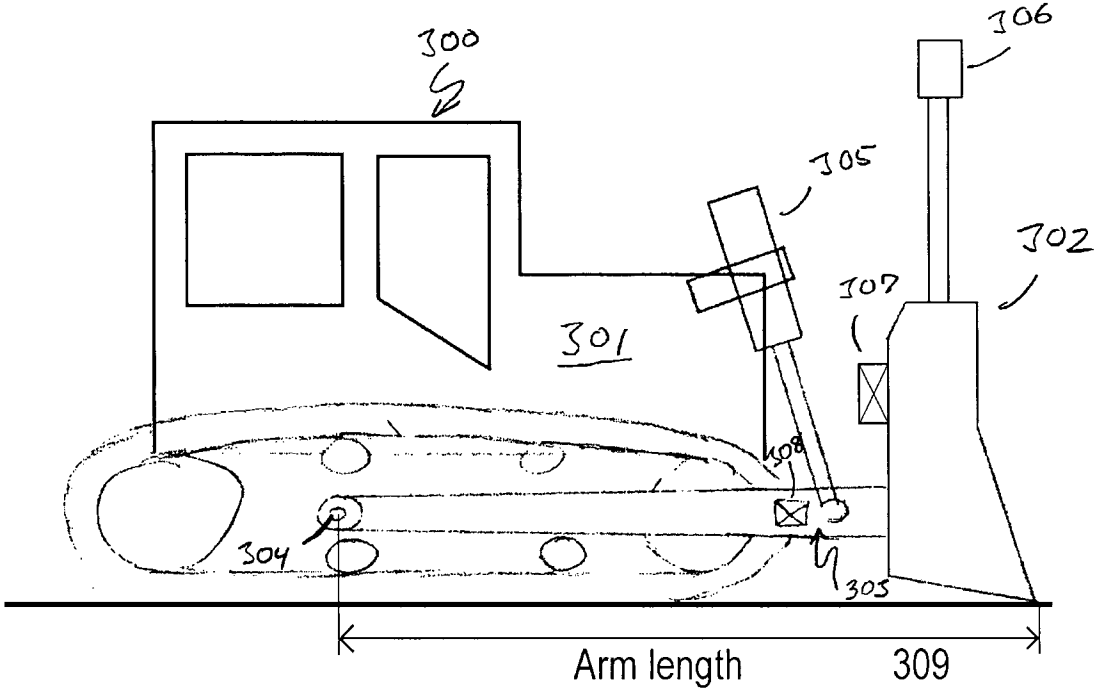
FIG. 3 shows the geometrical relationships that determine the functioning of the apparatus.

FIG. 3 illustrates an earth moving system [300] and in particular a bulldozer. Other types of earthmoving machines can also benefit from the invention. The requirement is that it has a cutting blade, which rotates around a point that can be estimated to be at a fixed distance from the target design surface. The reason is that a dozer drives over the finished surface defined by the cutting blade according to the target height.

The said system [300] has a body [301] and a cutting blade [302]. The cutting blade [302] is supported by two supporting arms [303] that extend from the body [301]. The supporting arms [303] are pivotally attached to the body [301] at the pivot point [304]. The supporting arms [303] include a pair of hydraulic cylinders [305], only one of which is shown in FIG. 3, for raising and lowering the blade in relation to the body [301]. In reality the cutting blade performs a rotating movement around a pivot point [304] so monitoring this rotating movement is as beneficial as monitoring the actual vertical movement. Cylinders [305] extend from the supporting arms and are attached at the other end at the body [301] and may be used to rotate the blade about the pivot point [304]. The bulldozer has a cab from which an operator may manually operate various controls to control the operation of the bulldozer.

The system further includes a height reference sensor [306] for determining the absolute position. This sensor is mounted on a pole which extends upwards from the cutting blade. Said sensor receives a signal relating to its position from one or more satellites associated with a GNSS system.

Alternatively the system may consist of a robotic total station or automatic total station ATS. The ATS transmits a beam of light to a reflective target [306] mounted on the pole that returns the light back in the same direction as it was received from. When receiving the reflection the ATS measures the heading, vertical angles and the distance to the target. This information and the position of the ATS are then converted to a position corresponding to the reflective target that is radio transmitted to the control system in the earth-moving machine.

Alternatively the system may consist of a laser transmitter for transmitting a reference beam of laser light. The beam of light is rotated about an axis to define a reference plane. As is well known, the reference plane may be tilted at a precisely controlled angle to the horizontal if a grade is to be defined by the plane of light. The receiver mounted on the pole is then a laser receiver receiving the rotating laser beam. The receiver detects the height of the beam making it possible to determine the distance to the cutting edge of the cutting blade.

The control system further includes an IMU that is mounted on the cutting blade [302] at position [307]. Alternatively the IMU is mounted on the supporting arms [303] at position [308]. In both cases the IMU measures the angular rate of the supporting arms [303] around the pivot points. If yawing of the blade around a vertical axis is possible it is preferred that the sensor is mounted on a supporting arm instead of on the cutting blade.

Summing up, known systems for automatic height control of a dozer blade, which rotates about a line through pivot points for supporting arms when it changes its height use feedback and a reference from an absolute blade height measuring system. This only permits a slow operation. According to the invention the input from the slow absolute height sensor is combined with an input from a fast gyroscope that measures the instant rotation and recalculates it into a vertical height change using the length of the supporting arms as the basis. The combination obtains the accuracy of the infrequent absolute height information and an increased speed of measurement resulting in a compensated height estimate that is input to a hydraulic control system of the feedback type. This improved height feedback enables much more aggressive control even though the hydraulic system has an unknown linearity and delay associated with it. The gyroscopic sensor forms an IMU with one degree of freedom to compensate for the inevitable drawbacks of the absolute height sensor in use with regard to delay, noise and update rate to obtain a frequent, time-correct height position with a reduced level of noise by means of a calculation based on both types of sensor output.

What is claimed is:

1. An apparatus for controlling in a closed loop the height of a front mounted blade on earth moving equipment, comprising:

said front mounted blade forming an aggregate with a pair of supporting arms connected to a body of the earth moving equipment at pivot points and rotated in planes perpendicular to a connecting line between said pivot points by means of hydraulic cylinders supplied via valves;

said front mounted blade carrying at least one absolute height sensor in the closed loop;

said aggregate carrying one inertial sensor in the closed loop;

outputs of said absolute height sensor and single inertial sensor being combined in a calculating unit, the outputs being devoid of body angle or body rotation of the body of the earth moving equipment;

output of said calculating unit and a set height being compared in a comparator, the comparator being in the controlled loop;

output of said comparator providing the input for a regulator for controlling said valves; and wherein said one inertial sensor has a single degree of freedom, the output of which is angular velocity in a plane perpendicular to the connecting line between said pivot points, which for use in said calculating unit is converted to angular increment of said supporting arms in said plane.

2. An apparatus according to claim 1, wherein the calculating unit further applies a conversion factor when converting from angular increment to a height displacement at the front mounted blade.

3. An apparatus according to claim 2, wherein the conversion factor is the length of the supporting arm.

4. An apparatus according to claim 1, wherein said one inertial sensor has a negligible sensitivity to linear accelerations and rotation out of a plane perpendicular to the connecting line between said pivot points.

5. An apparatus according to claim 4, wherein said one inertial sensor is a gyroscope for sensing angular velocity of the supporting arms.

6. An apparatus according to claim 4, wherein said one inertial sensor is provided with bias-compensation.

7. An apparatus according to claim 1, wherein said one inertial sensor is mounted on the front mounted blade.

8. An apparatus according to claim 1, wherein said one inertial sensor is mounted on one of the supporting arms.

9. An apparatus according to claim 8, wherein said one inertial sensor is mounted on a supporting arm in the case that the front mounted blade is mounted rotatable around a vertical or horizontal axis.

10. An apparatus according to claim 1, wherein said absolute height sensor is a GNSS sensor.

11. An apparatus according to claim 1, wherein said absolute height sensor is an automatic total station.

12. An apparatus according to claim 1, wherein said absolute height sensor is a laser receiver.

13. A method for forming a surface on the ground by earth moving equipment with a pair of supporting arms for a blade, said blade being controlled in a closed loop when lifted and lowered by means of hydraulic cylinders supplied via valves, the method comprising the steps of:

inputting a target surface profile to the closed loop;

automatically receiving measurements into the closed loop from at least one absolute height sensor mounted on the blade;

automatically receiving measurements into the closed loop from one inertial sensor with a single degree of freedom mounted on an aggregate, the aggregate consisting of the blade and its supporting arms;

automatically feeding said measurements from said at least one absolute height sensor and one inertial sensor to a calculating unit in the closed loop, said measurements being devoid of body angle or body rotation of the body of the earth moving equipment; and comparing output of said calculating unit to a set height of the target surface profile in a comparator in the closed loop which gives an input to a regulator for controlling said valves, thereby controlling an elevation of the blade based on the measurements received from the at least one height sensor and the measurements received from the one inertial sensor having the single degree of freedom, while setting the earth moving equipment in motion.

* * * * *